United States Patent [19]

Jeffras et al.

[11] 4,393,991

[45] Jul. 19, 1983

[54] SONIC WATER JET NOZZLE

[75] Inventors: Nathaniel B. Jeffras, Woodland Hills; Robert H. Torgersen, Canoga Park, both of Calif.

[73] Assignee: Automation Industries, Inc., Greenwich, Conn.

[21] Appl. No.: 268,286

[22] Filed: May 29, 1981

[51] Int. Cl.[3] ..... B05B 17/06

[52] U.S. Cl. ..... 239/102; 239/590.5

[58] Field of Search ..... 239/102, 461, 590.5, 239/600

[56] References Cited

U.S. PATENT DOCUMENTS

| | | | |
|---|---|---|---|
| 40,847 | 12/1863 | Macy et al. | 239/461 |
| 645,027 | 3/1900 | Baker | 239/461 |
| 814,694 | 3/1906 | Henderson | 239/461 |
| 2,627,439 | 2/1953 | Wornall | 239/590.5 |
| 2,707,624 | 5/1955 | Shames et al. | 239/461 |
| 4,004,736 | 1/1977 | George | 239/102 |

FOREIGN PATENT DOCUMENTS

| | | | |
|---|---|---|---|
| 758274 | 10/1956 | United Kingdom | 239/461 |

*Primary Examiner*—John J. Love
*Assistant Examiner*—Michael J. Forman
*Attorney, Agent, or Firm*—Francis N. Carten

[57] ABSTRACT

A nozzle body has an elongated, conical passage with the smaller end opening facing in the direction it is desired the jet to travel. At right angles thereto, a fitting in the nozzle body interconnects with a supply of pressurized water. The pressurized water enters into a manifold or plenum surrounding a chamber in which a sonic transducer is located. The manifold wall has a plurality of openings arranged in a circle for directing pressurized water into the conical chamber along each of the openings. Water from the manifold serves to fill the enclosure containing the sonic transducer to provide full fluid coupling throughout the entire interior of the jet nozzle construction. A set of fins are arranged about the walls defining the conical passage to stabilize water moving therethrough and reduce any tendency to rotate on emission.

10 Claims, 4 Drawing Figures

SONIC WATER JET NOZZLE

The present invention relates generally to a sonic water jet nozzle and, more particularly, to an improved nozzle for emitting a laminar column of water substantially free from surface irregularities over an extended length and along which sonic energy passes.

BACKGROUND OF THE INVENTION

Sonic and especially ultrasonic energy is being increasingly utilized in the nondestructive testing or inspection of parts for defects. In a typical form of such apparatus a quantity of water on the part to be tested serves as a coupling means for sonic energy generated by a relatively remotely located transducer. It has been found that even the presence of a very small amount of surface irregularity in the column causes sonic reflections which substantially impair operation of the apparatus by impeding flow of the sonic energy through the water to the test piece. It is therefore a desideratum to provide water coupling between the sonic transducer and the surface to be inspected which is as free from surface irregularities as possible.

In a frequently encountered testing apparatus particularly for use in the scanning inspection of large sheetlike surfaces by sonic means, a jet-like stream of water is emitted toward the surface to be tested and along which jet the sonic energy passes. U.S. Pat. No. 4,004,736 granted Jan. 25, 1977 discloses an ultrasonic water jet for use in this general type of apparatus and which is stated as providing a 4 to 6 inch stream of water which is unbroken and free of bubbles.

Both the patented device as well as other known devices for producing water jets in the art have not been found capable of producing a jet or stream free from surface irregularities extending for more than about 6 inches, and this fact sets an inherent restriction on present sonic nondestructive test equipment. That is, either the jet nozzles have to be located close enough to the test piece so that the stream will be in its pure homogeneous state, which is not always possible, or the degradation in the water stream associated with greater lengths of the stream must be compensated for in some manner.

SUMMARY OF THE INVENTION

There is provided in the practice of the present invention a nozzle construction including a nozzle body with an elongated, conical opening having the smaller end opening facing in the direction it is desired the jet to travel. At right angles thereto, a fitting in the nozzle body interconnects with a supply of pressurized water. The pressurized water enters into a manifold or plenum surrounding a chamber in which a sonic transducer is located. The manifold wall has a plurality of openings arranged in a circle for directing pressurized water into the conical chamber along each of the openings. Water from the manifold serves to fill the enclosure containing the sonic transducer to provide full fluid coupling throughout the entire interior of the jet nozzle construction. A set of thin metal fins are arranged about the conical walls defining the conical chamber which serves to stabilize water moving therethrough and reduce any tendency to rotate on emission which has been found to cause surface irregularities.

DESCRIPTION OF THE PREFERRED EMBODIMENT

Figure 1:
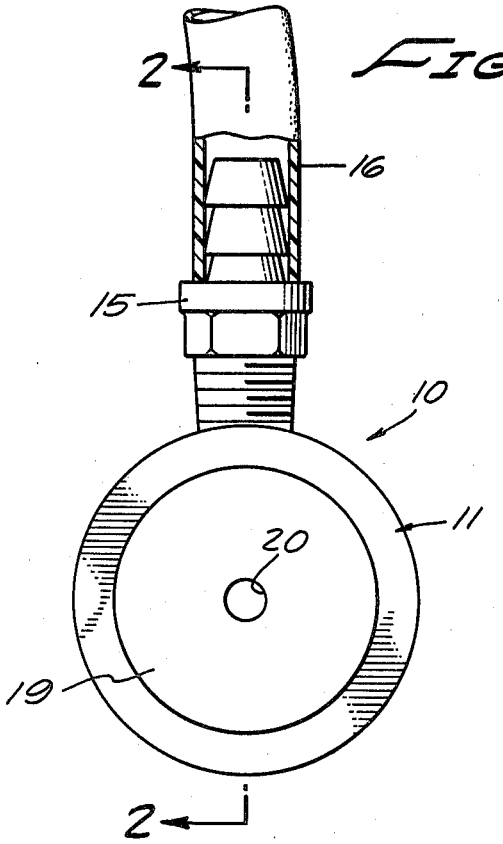
FIG. 1 is an end elevational view of the sonic water jet nozzle of this invention shown viewing into the exit opening.
Figure 3:
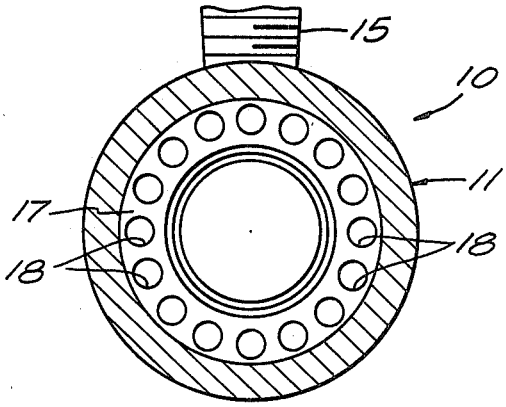
FIG. 3 is a sectional, end elevational view taken along the line 3—3 of FIG. 2.
Figure 2:
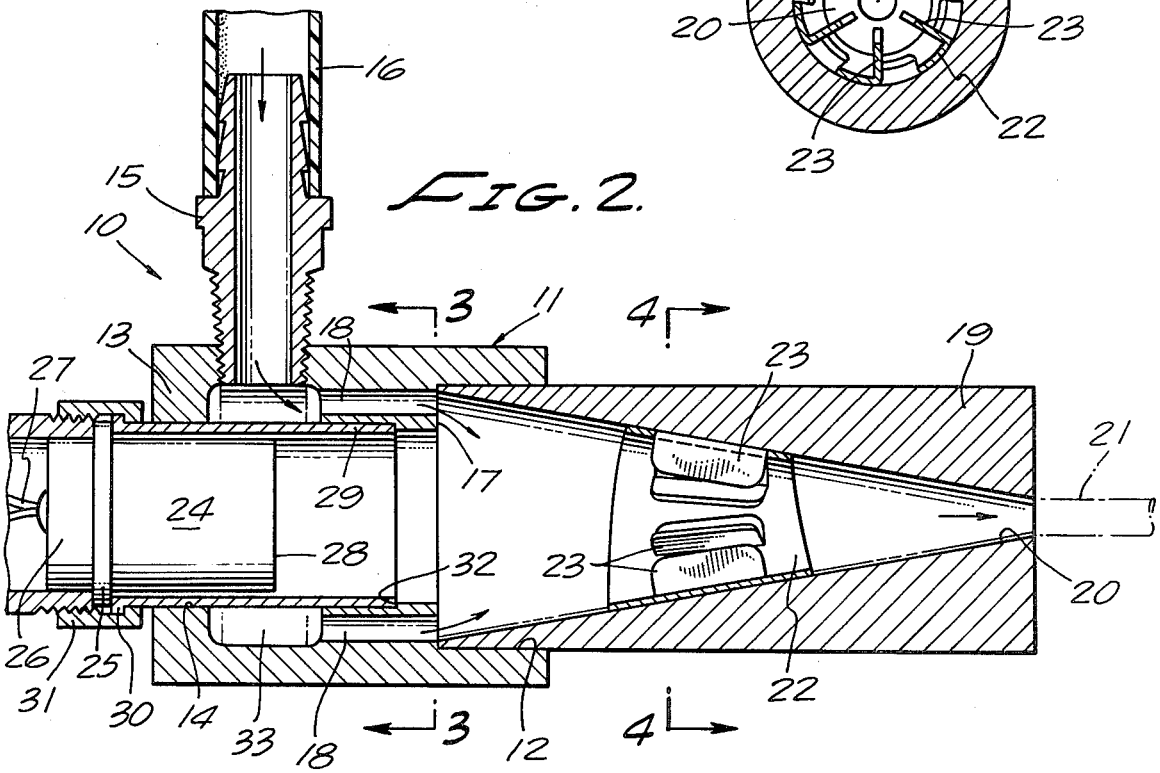
FIG. 2 is a side elevational, sectional view taken along the line 2—2 of FIG. 1.

With reference now to the drawings and particularly FIGS. 1 and 2, the water jet nozzle of this invention is identified generally as at 10 and is seen to include a generally cylindrical tubular housing 11 having an open end 12 and a partially closed end 13 with an opening 14 therein for a use to be described. A suitable fitting 15 is threadedly received within the side wall of the housing 11 and interconnected by a pipe or tube 16 to a suitable supply of pressurized water.

The inner wall of the housing 11 spaced slightly inwardly from its open end 12 has been removed to form an enlarged opening that terminates inwardly at an annular shoulder 17. A plurality of equally spaced passages 18 arranged in a circle about the longitudinal axis of the tube 11 are formed in the annular shoulder 17 and are in open communication with incoming water from 16 through the fitting 15, allowing it to exit free from rotation in the direction of the arrow toward the tube open end 12.

An elongated cylindrical nozzle body 19 has an external diameter such as to enable fitting receipt of an end portion within the open end 12 in housing 11 at which time the nozzle body end abuts against the annular shoulder 17. A conical passage 20 extends longitudinally within the nozzle body with its large end opening at the end of the nozzle body 19 received within housing 11 and its small end opening at the opposite end. It is to be noted that the large end of the passage 20 has a sufficient diameter to provide ready communication between each of the openings 18 and the conical passage 20 such that incoming water from the tube 16 will make its way along the direction of the arrow through the fitting 15, along the passages 18 into the conical passage 20 and thence outwardly from the nozzle body as a stream of water 21.

Figure 4:
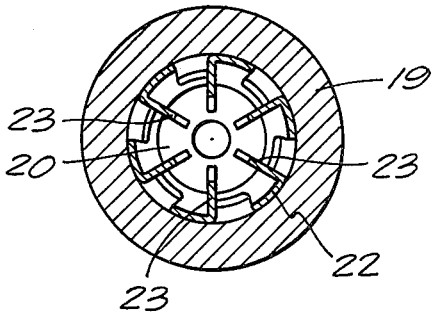
FIG. 4 is a sectional end elevational view taken through the stabilizing fins along the line 4—4 of FIG. 2.

With reference now particularly to FIGS. 2 and 4, it is seen that substantially midway along the longitudinal dimension of the conical passage 20 there is located a thin metal sheet 22 which conforms closely to the walls of the passage 20 and includes a plurality of finlike members 23 extending from the wall towards the center of the opening. More particularly, the metal sheet is a strip laid out with two edges curved so that when the other strip edges are brought together the peripheral surface of the hollow tube so formed will match the curvature of the cone of passage 20. The finlike tabs are stamped from the metal and bent inwardly so as to extend radially partway towards the central axis of the conical opening but having their inner ends spaced from each other. Each of the fins is radially located within the passage and terminates at an inner edge that is substantially parallel to the wall surface defining passage 20.

A sonic transducer 24 has a generally cylindrical construction with an enlarged mounting ring 25 extending circumferentially thereabout. One end 26 includes energizing wires 27 and the opposite end 28 is the active or vibrating surface. A hollow mounting tube 29 has an internal diameter sufficient to receive the transducer main body in a loosely fitting arrangement and an enlarged hub 30 against which the mounting ring 25 abuts. Typically, the transducer is secured to the mounting tube by a pipe and nut arrangement 31. The tube 29 has an outer diameter which snugly fits within the opening 14 of housing 11, and the tube inner end abuts against a shoulder 32 both for securement and to fixedly locate the transducer.

In operation of the described apparatus, first pressurized water is added via the fixture 15 which fills a first chamber 22 in housing 11, the passage 20 in the nozzle body as well as the interior of mounting tube 29. Accordingly, on the transducer being energized there is full and complete fluid coupling of the sonic energy produced by the transducer and the emitted water stream 21.

As a result of adding pressurized water to the conical opening or passage 20 via the circular set of passages 18 and stabilizing fluid flow by the fins 23, a completely bubble free stream or smooth water column 21 is obtained having a length substantially greater than that provided by any known nozzle means. For example, in actual comparative tests of a practical construction of the invention with available nozzles established a clear superiority in performance. Thus, whereas one known nozzle produced a bubble-free column of water for 4 inches from the end of the nozzle and a second known nozzle produced such a column 6 inches from the nozzle end, the present invention provided a column that showed no tendency to break until after 10 inches from the nozzle end.

A most important factor in the production of a smooth water column (i.e., no surface irregularities) is the prevention or substantial reduction of column water rotation. That is, it has been found that if the stream or column emitted from the nozzle rotates, it will break down quicker and form surface irregularities that attenuate sonic energy. The passages 18 and fins 23 are believed to be responsible for preventing any tendency for the emitted water stream 21 to rotate.

A second adverse aspect of known prior nozzles for this general purpose has been the attenuation of sonic energy within the nozzle itself. In this invention, a gentle slope of the nozzle interior such that the sonic energy reflects from, rather than refracts into the surface 20, is believed of critical effect in maintaining the transmission of sonic energy relatively unimpaired through the nozzle.

The invention claimed is:

1. A sonic water jet nozzle, comprising:

a housing including a chamber for containing a source of sonic energy, and walls defining a plurality of substantially parallel passages lying outwardly of the first chamber, one end of each passage being in open communication with said chamber in said housing and the other end of each passage opening to the exterior of said housing;

means for interconnecting the other ends of the passage at the housing exterior to a source of pressurized fluid;

a nozzle body having a conical passage therethrough with a relatively large opening at one surface and a relatively small opening at another surface, the centerline of said conical passage being substantially parallel to said plurality of passages;

said nozzle body being interconnected with the housing such that the large opening communicates with the chamber and the plurality of passages; and radially extending finlike means received within said conical passage for retarding rotation of water passing through the nozzle body conical passage.

2. A sonic water jet nozzle as in claim 1, in which the plurality of passages in said housing are arranged symmetrically about a common line which lies along the longitudinal axis of said conical passage.

3. A sonic water jet nozzle as in claim 2, in which the plurality of passages are arranged equally spaced in a circular path about the chamber with each other end of said passages communicating with both the conical passage and said chamber.

4. A sonic water jet nozzle as in claim 1, in which the finlike means include a plurality of thin-walled fins extending inwardly from the wall defining the conical passage.

5. A sonic water jet nozzle as in claim 4, in which said conical passage is circular in cross-section and the fins extend radially inwardly leaving an axial region of the conical passage free of fins.

6. A sonic water jet nozzle, comprising:

a housing including a chamber for containing a source of sonic energy, and walls defining a plurality of substantially parallel passages lying outwardly of the first chamber and arranged symmetrically in a circular path about said chamber, one end of each passage in open communication with the chamber in said housing and the other end of each passage opening to the exterior of said housing;

means for interconnecting the chamber to a source of pressurized fluid;

a nozzle body having a conical passage of circular cross-section extending therethrough with a relatively large opening at one surface and a relatively small opening at another surface;

said nozzle body being interconnected with the housing such that the large opening communicates with the housing chamber and the plurality of passages, said plurality of passages being symmetrically arranged about the conical passage circular axis; and finlike means received within said conical passage for retarding rotation of water moving about the circular axis on through said passage.

7. A sonic water jet nozzle as in claim 6, in which the finlike means include a plurality of thin-walled fins extending inwardly from the wall defining the conical passage.

8. A sonic water jet nozzle as in claim 7, in which said fins extend radially inwardly leaving an axial region of the conical passage free of fins.

9. A sonic water jet nozzle as in claim 6, in which said finlike means includes a relatively thin metal sheet having a major surface conforming to the wall surface defining the conical passage and having fins formed from said metal sheet.

10. A sonic water jet nozzle as in claim 9, in which said fins each have an inner edge that is substantially parallel to a wall surface defining the conical passage.

* * * * *